United States Patent [19]

Jego et al.

[11] Patent Number: 4,911,651

[45] Date of Patent: Mar. 27, 1990

[54] SUPPLY BOX FOR ELECTRIC DUCTING

[75] Inventors: Gérard Jego, Brazey En Plaine; Jean-Yves Teinturier, Longvic; Jean-Pierre Thierry, Couternon; José Garcia, Dijon, all of France

[73] Assignee: La Telemecanique Electrique, France

[21] Appl. No.: 330,408

[22] Filed: Mar. 30, 1989

[30] Foreign Application Priority Data

Mar. 31, 1988 [FR] France ..... 88 04261

[51] Int. Cl.[4] ..... H01R 13/64; H01R 25/00

[52] U.S. Cl. ..... 439/207; 439/497; 439/681

[58] Field of Search ..... 439/488, 497, 677, 687, 439/207, 212

[56] References Cited

U.S. PATENT DOCUMENTS 4,557,547 12/1985 Stuart ..... 439/207

*Primary Examiner*—Gary F. Paumen

*Attorney, Agent, or Firm*—William A. Drucker

[57] ABSTRACT

The invention provides a supply box for electric ducting able to be mounted at both ends of an electric distribution ducting. This box comprises a movable part with foolproof means which may be moved transversely with respect to the axis of the ducting, between a first position in which the foolproof means cooperate with associated foolproof means on the ducting so as to allow connection of the box to the ducting and a second position making such connection impossible. Marks provided on the movable part make it possible to identify the conductors of the box for each of the two positions.

9 Claims, 2 Drawing Sheets

SUPPLY BOX FOR ELECTRIC DUCTING

BACKGROUND OF THE INVENTION

The invention relates to a supply box for the ducting of electric distribution systems, of a type comprising a metal conduit with generally rectangular and elongate cross section, inside which conducting bars are held in position by means of insulators, connections being made on these bars by means of appropriate connection boxes.

Such ductings are currently well known in workshops and factories. They are supplied with electric power by their ends on which supply boxes are connected which are also well known.

In some cases, for example where the ducting is installed along a wall, such boxes nevertheless have the drawback that they must be of two different types depending on whether the supply is on the right or on the left of the ducting: the concordance of the phases and of the neutral then requires marking on the supply box in accordance with the active conductors of the ducting. Of course, this results in additional expense in manufacturing such devices and raises storage problems.

Therefore, the object of the present invention is to provide a supply box of the above specified kind which may be used indifferently on the right or on the left, without the fear of connection errors and avoiding delicate handling operations.

SUMMARY OF THE INVENTION

To reach this result, the invention provides a supply box capable of being mounted on the ends of an electric distribution ducting of the type comprising a rigid or semi-rigid tubular conduit containing a plurality of axial conducting elements disposed in the same configuration at least at both ends of the ducting, these conducting elements each having, depending on its position in said configuration, a functional character distinct from that of the other conducting elements, said box comprising connection devices adapted in accordance with said configuration, so as to be able to be coupled to said conductors at one or the other of the ends of the ducting, these connection devices each comprising means for connection to a flexible conductor of a supply cable, such connection being made so that each flexible conductor has the same functional character as the connector element to which it is connected.

According to the invention, this supply box is more particularly characterized in that it comprises functional character identification means including a movable part with two series of identification symbols and having foolproof means, this part being movable between two lockable positions, namely: a first position in which the foolproof means can be engaged with foolproof means provided at one of the ends of the ducting, so as to permit coupling of the connection devices on said conducting elements and a second position in which the foolproof means may cooperate with corresponding foolproof means on the second end of the ducting so as to permit, at the second end, the coupling of the connection devices to said conducting elements, the identification symbols being adapted so that, for each of said two positions of said part, they indicate the functional characters of the flexible conductors to be connected to said connection means.

It will be understood that the foolproof means of the invention make it possible to prevent connection of the supply box to an end of the ducting if the movable part is not in the correct position, and therefore if the functional characters, which the flexible conductors to be connected to the connection means must have, are not correctly indicated.

To make such connection, it is then necessary to move transversely the movable part of the supply box and arrange the flexible conductors in the way indicated by the identification symbols. The first operation in practice guarantees that the second operation will take place, which eliminates any risk of error.

Preferably, the foolproof means in question comprise at least one spur integral with the movable part of the invention, this spur cooperating with a recess or notch of corresponding shape in the ducting.

Furthermore, the device advantageously comprises two spurs, which improves the positioning of the assembly and increases its mechanical strength and these spurs preferably have oblique ramps facilitating their insertion in the corresponding recesses.

In an advantageous embodiment, the supply box of the invention comprises a case in which the movable part is mounted, the foolproof means projecting from this case, whereas the movable part may be fixed to this case by means of at least one screw passing through a transverse elongate aperture.

Preferably, at least one of these screws is screwed from inside the case of the supply box. With this arrangement, and especially if this inside screw is disposed under the passage of one of the conductors, the risks of oversights and errors are further limited, for unscrewing is indispensable to move the movable part, which almost necessarily involves the disconnection of the conductors.

Advantageously, the selection of said identification symbols is made by means of corresponding windows formed in the case at positions such that only the symbols to be used in these positions can be read in one of said positions of the movable part.

Finally, the supply box of the invention is preferably mounted on the ducting by means of a fish-plate which is provided with first foolproof means ensuring correct positioning thereof on each of the ends of the ducting and second foolproof means cooperating with the foolproof means provided in the identification means equipping the box.

BRIEF DESCRIPTION OF THE DRAWINGS

The following description, which has no limitative character, will better show how the present invention may be put into practice, with reference to the accompanying drawings in which.

DESCRIPTION OF THE PREFERRED EMBODIMENTS

Figure 1:
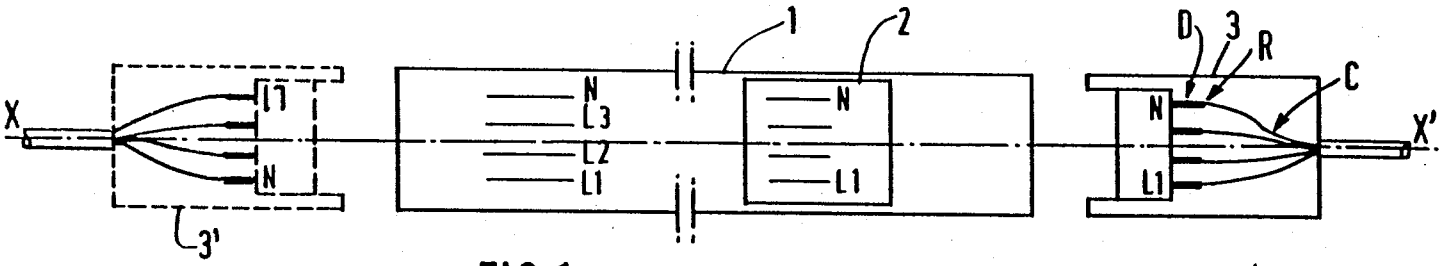
FIG. 1 shows schematically an electricity distribution ducting and supply boxes belonging to the state of the art.
Figure 2:
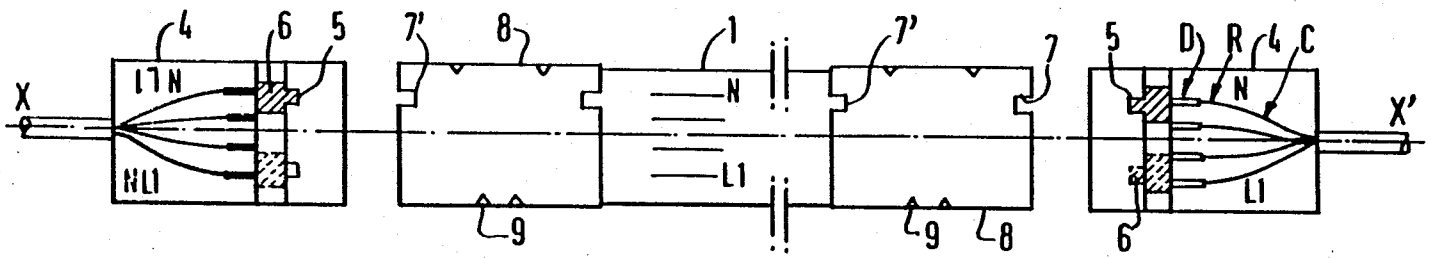
FIG. 2 is similar to FIG. 1 but the supply boxes which it shows are in accordance with the present invention.

In the general diagram shown in FIGS. 1 and 2, the reference 1 designates a conventional ducting for the distribution of electric energy, of the kind currently met with in workshops and factories. Such ducting comprises a rigid metal conduit, with a generally rectangular and elongate cross section, inside which conducting bars are mounted via insulators, connections being able to be made on these bars by means of appropriate connection boxes, one of which is shown schematically at 2.

The bars in question here comprise a neutral N and three lines L1 to L3. The electric energy supply is brought on the right or on the left by a supply box 3 also comprising connection devices D adapted for coupling to the conductors N, L1, L2, L3. Each of these devices comprises connection means R for connection to a flexible conductor C of a supply cable.

Since this supply box 3 is not symmetrical with respect to the plane of the ducting, it is clear that if an attempt is made to use the supply box 3 which is mounted on the right of the ducting 1 in FIG. 1 for supplying this ducting from its left-hand end, as is shown with broken lines at 3' in this same FIG. 1, its neutral N will be connected to the lower line L1, which must be avoided at all costs for obvious reasons.

The result is that two types of supply boxes must be used, one for right-hand connection to the ducting and the other for left-hand connection, these two types of apparatus having further to be supplied with foolproof means and/or appropriate marking to avoid any incorrect coupling.

According to the invention, on the contrary, and as is shown in FIG. 2, the same type of supply box may be used on the right or on the left. For this, the box in question 4 is provided with foolproof means which, to facilitate the explanations, are shown schematically in the right-hand part of FIG. 2 by a spur 5 which is formed on a movable part 6 of the supply box 4 and which cooperates with an external facing recess 7 formed in a fish-plate 8 mounted at the end of ducting 1.

More precisely, part 6 is movable, transversely with respect to the conductors, between a connection position shown with continuous lines in FIG. 2 in which spur 5 may penetrate into recess 7 and a symmetrical position with respect to the longitudinal axis X-X' of the system which is indicated with broken lines and in which such penetration is impossible.

Of course, the longitudinal position of the conductors in fish-plate 8 and in the supply box 4 is such that they cannot touch each other in the second connection prohibition position, even if an attempt is made. Furthermore, the movable part 6 of the supply box 4 may be locked in each of these two positions by means which will be described further on.

Turning now to fish-plate 8, it has at its other end a recess 7' which is, for example, symmetrical with recess 7 and so situated at the same distance as it from the axis X-X' of the system, and which is not used for the right-hand connection of FIG. 2. It is further provided with foolproof teeth 9 requiring it to be always fitted in the same direction on ducting 1, recesses 7 and 7' being for example always above its axis X-X' in the example shown.

If the fish-plate 8 is now mounted on the right-hand end of ducting 1, if we assume that the movable part 6 of the supply box 4 is in its connection position shown with continuous lines in FIG. 2, its spur 5 then being locked in its top position, facing recess 7, and if an attempt is then made to connect box 4 to the left-hand end of ducting 1 or, more exactly, to the fish-plate 8 mounted at this end, it is clear that such connection will be impossible, as is shown with broken lines in FIG. 2: spur 5 will in fact have passed below the axis X-X' and it cannot penetrate into the recess 7' of fish-plate 8 which is still above this axis.

To effect such connection, the movable part 6 of the supply box 4 must be unlocked and spur 5 brought into its other position which is symmetrical with respect to the axis X-X', so that it is then above the latter and may penetrate into the recess 7 of fish-plate 8, as is shown with continuous lines in FIG. 2. Of course, this modification must imperatively be accompanied by the manual inversion of conductors N, L1, L2, L3, which is also indicated in FIG. 2, for if not we would have the left end situation shown in FIG. 1, which is to be avoided. However, it is clear that an oversight is excluded in practice, the operation of moving the movable part 6 automatically reminding the operator to invert the conductors.

Figure 3:
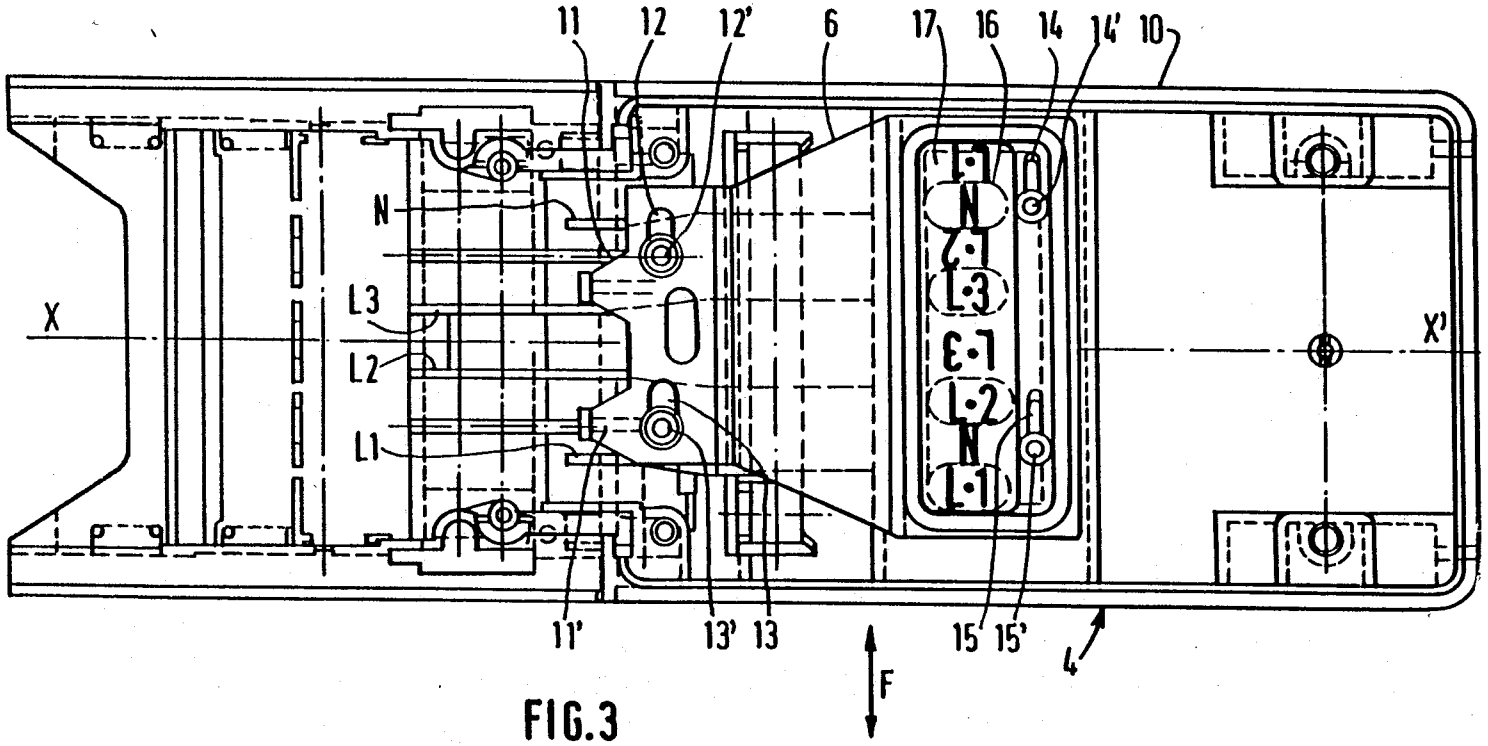
FIG. 3 shows a top view of a supply box of the invention whose cover has been removed.

Turning now to the embodiment shown in FIG. 3, we find again the supply box 4 comprising a case 10 in which the movable part 6 is mounted, the latter being able to take up, by transverse translation as shown by arrows F, two positions shown respectively with continuous lines and broken lines and corresponding respectively to the right and left hand connection. The current lead-in conductors have been designated again by N, L1, L2 and L3 and the fish-plate 8 has not been shown.

In this case, spur 5 is here replaced by two spurs 11 and 11' which are integral with the movable part 6 and which are movable therewith between two positions symmetrical with respect to the axis X-X' of the system. Of course the fish-plates 8, not shown, also have two recesses 7 or 7' of corresponding shape and position. Spurs 11 and 11' are advantageously provided with oblique lateral ramps which facilitate their introduction into associated recesses.

The lateral sliding of the movable part 6 is provided by four transverse apertures 12 to 15 through which pass respectively screws 12' to 15' which are screwed into the case 10 and which, when tightened up, lock the movable part 6 and so the spurs 11 and 11' with respect to case 10.

More precisely, the two screws 12' and 13' are tightened from the bottom of case 10, their heads bearing thereon, whereas the other two screws 14' and 15' are screwed from inside case 10 under the passage of the neutral conductor N and one of the lines L1 to L3. It is indispensable to unscrew them in order to move the movable part 6 from one position to another, which involves almost necessarily the inversion of the conductors, and further limits the risks of oversight.

Finally, a portion of the movable part 6 extends against the lower face of case 10 which comprises four windows 16. It has a label 17 on which are printed two identical but inverted series of indications N, L1, L2, L3, such indications being disposed so that, depending on the position of the movable part 6, it is one or other of these series which appears in the windows 16, in the appropriate direction, which makes the nature and position of the different connected conductors perfectly visible and detectable.

Without departing from the scope of the present invention, different modifications could of course be made to the embodiment which has just been described. Thus, the spurs 11 could be different in number or even be replaced by another coupling system.

What is claimed is:

1. A supply box capable of being mounted on the ends of an electric distribution ducting of the type comprising a rigid or semi-rigid tubular conduit containing a plurality of axial conducting elements disposed in the same configuration at least at both ends of the ducting, these conducting elements each having, depending on its position in said configuration, a functional character distinct from that of the other conductor elements, said box comprising connection devices arranged in accordance with said configuration, so as to be able to be coupled to said conductors at one or other of the ends of the ducting, these connection devices each comprising means for connection to a flexible conductor of a supply cable, such connection being made so that each flexible conductor has the same functional character as the connection device to which it is connected, said box further comprising functional character identification means including a movable part with two series of identification symbols and having foolproof means, this part being movable between two lockable positions, namely: a first position in which the foolproof means can be engaged with foolproof means provided at one of the ends of the ducting, so as to permit coupling of the connection devices to said conducting elements, and a second position in which the foolproof means may cooperate with corresponding foolproof means on the second end of the ducting so as to permit, at the second end, the coupling of the connection devices to said conducting elements, the identification symbols being adapted so that, for each of said two positions of said part, they indicate the functional characters of the flexible conductors to be connected to said connection means.

2. The supply box as claimed in claim 1, wherein said foolproof means of the movable part comprises at least one spur integral with said movable part which is adapted to cooperate with a recess of corresponding shape in said ducting.

3. The supply box as claimed in claim 2, comprising two said spurs.

4. The supply box as claimed in claim 2, wherein said spurs have oblique insertion ramps on their sides.

5. The supply box as claimed in claim 1, including a case in which said movable part is mounted, said foolproof means integral with said movable part projecting out of this case and said movable part being fixed to this case by means of at least one screw passing through an elongate transverse aperture on the case.

6. The supply box as claimed in claim 5, wherein at least one of said screws is screwed from inside said case.

7. The supply box as claimed in claim 6, wherein said inside screw is screwed under one of the conductors.

8. The supply box as claimed in claim 1, wherein said case comprises a series of windows revealing one of the series of identification symbols in one of said positions of the movable part and the other series of identification symbols in the other position of said part.

9. The supply box as claimed in claim 1, wherein it is mounted on said ducting by means of a fish-plate which is provided with first foolproof means ensuring its correct positioning on the ducting and which comprises second foolproof means associated with the foolproof means integral with the movable part.

* * * * *